US005586480A

United States Patent [19]

Gardner

[11] Patent Number: 5,586,480

[45] Date of Patent: Dec. 24, 1996

[54] PNEUMATIC MOTOR

[75] Inventor: Richard K. Gardner, Montpelier, Ohio

[73] Assignee: Ingersoll-Rand Company, Woodcliff Lake, N.J.

[21] Appl. No.: 604,147

[22] Filed: Feb. 20, 1996

[51] Int. Cl.[6] ..... F01B 7/20; F15B 11/08

[52] U.S. Cl. ..... 91/169; 91/464; 91/469

[58] Field of Search ..... 92/51, 52; 91/169, 91/462, 464, 469

[56] References Cited

U.S. PATENT DOCUMENTS

| | | | |
|---|---|---|---|
| 400,401 | 3/1889 | Gutzkow . | |
| 616,973 | 1/1899 | Rhodes . | |
| 785,324 | 3/1905 | Norling . | |
| 1,010,859 | 12/1911 | Christiansen . | |
| 1,353,796 | 9/1920 | Stage . | |
| 1,626,087 | 4/1927 | Hultquist . | |
| 1,726,334 | 8/1929 | Bayles . | |
| 1,804,805 | 5/1931 | Phillips | 91/462 X |
| 2,389,654 | 11/1945 | Werff | 91/462 X |
| 2,733,688 | 2/1956 | Badenoch | 91/464 X |
| 3,628,419 | 12/1971 | Doughton . | |
| 3,918,351 | 11/1975 | Finke | 91/469 X |
| 4,386,888 | 6/1983 | Verley . | |
| 5,092,746 | 3/1992 | Henke . | |

OTHER PUBLICATIONS

Orion Sales Brochure for Reciprocating Pumps, 1993.
Graco Sales Brochure for Double Acting Oil Pumps, 1994

*Primary Examiner*—Hoang Nguyen
*Attorney, Agent, or Firm*—Michael M. Gnibus

[57] ABSTRACT

A pneumatic motor including a motor body having a piston chamber with opposed chamber ends, at least two valve chambers, an inlet for flowing a pressurized fluid into the piston chamber and each of the at least two valve chambers, a number of outlets provided in the housing for exhausting the pressurized fluid from the piston chamber and each of the at least two valve chambers. The motor also includes a three-way valve member adapted to be located in each of the at least two valve chambers, the valve members each have at least one open end and at least one port formed along the valve member body. A spool member is located in one of the valve chambers, each spool member has a first end adapted to be located in the open end of the valve member. The spool members are adapted to be movable in a first direction relative to the valve member to permit pressurized fluid to be supplied to the piston chamber and also in a second direction relative to the valve member to permit the pressurized fluid in the piston chamber to be exhausted from the chamber. A piston is movable in a reciprocating manner in the main chamber in response to movement by the spools relative to the three-way valve members.

12 Claims, 5 Drawing Sheets

PNEUMATIC MOTOR

FIELD OF THE INVENTION

This invention generally relates to pneumatic motors, and more particularly to an improved pneumatic motor having a piston movable in a piston chamber and at least two three-way valves each located in a valve chamber and each valve having a spool movable in a valve chamber to alternately provide pressurized supply fluid to and exhaust the pressurized fluid from opposite ends of the piston cylinder.

DESCRIPTION OF THE PRIOR ART

Pneumatic motors are used to drive a piston through a cylinder in a reciprocating manner to pump a fluid such as grease or oil from a storage tank or drum to an object of interest such as a car, truck or the like.

In order to achieve the desired reciprocating motion by the piston, a pressurized fluid, such as air is alternately supplied to opposite ends of a piston cylinder chamber. As the pressurized fluid is supplied to one end of the cylinder chamber, fluid in the opposite chamber end is exhausted from the cylinder chamber. For example, providing supply air to the first end of the piston chamber forces the piston to the second chamber end, and exhausting the air from the first cylinder chamber end and providing supply air to the second chamber end forces the piston to the first end of the cylinder chamber. This alternating supply/exhaust pattern is repeated as long as pressurized fluid is supplied to the motor.

Typically, the alternating supply/exhaust pattern is achieved by reversing the direction of a four-way valve member. By reversing the four-way valve member, opposite ends of the cylinder are alternately connected to supply pressure or exhaust. The direction of movement of the four-way valve may be shifted by a mechanism that is actuated pneumatically, mechanically or by a combination of pneumatics and mechanics.

However these known shifting mechanisms are quite complicated and may for example use trip rods, trip pins, popper members and spring devices to shift the four-way valve. Even when the shifting mechanisms are actuated pneumatically, the shifting mechanisms require a signal to reset the valve.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

A pneumatic motor including a motor body having a piston chamber with opposed chamber ends, at least two valve chambers, an inlet for flowing a pressurized fluid into the piston chamber and each of the at least two valve chambers, a number of outlets provided in the housing for exhausting the pressurized fluid from the piston chamber and each of the at least two valve chambers. The motor also includes a three-way valve member adapted to be located in each of the at least two valve chambers, the valve members each have at least one open end and at least one port formed along the valve member body. A spool member is located in one of said valve chambers, each spool member has a first end adapted to be located in the open end of the valve member. The spool members are adapted to be movable in a first direction relative to the valve member to permit pressurized fluid to be supplied to the piston chamber and also in a second direction relative to the valve member to permit the pressurized fluid in the piston chamber to be exhausted from the chamber. A piston is movable in a reciprocating manner in the main chamber in response to movement by the spools relative to the three-way valve members.

The foregoing and other aspects will become apparent from the following detailed description of the invention when considered in conjunction with the accompanying drawing figures.

BRIEF DESCRIPTION OF THE DRAWING FIGURES

Figure 2:
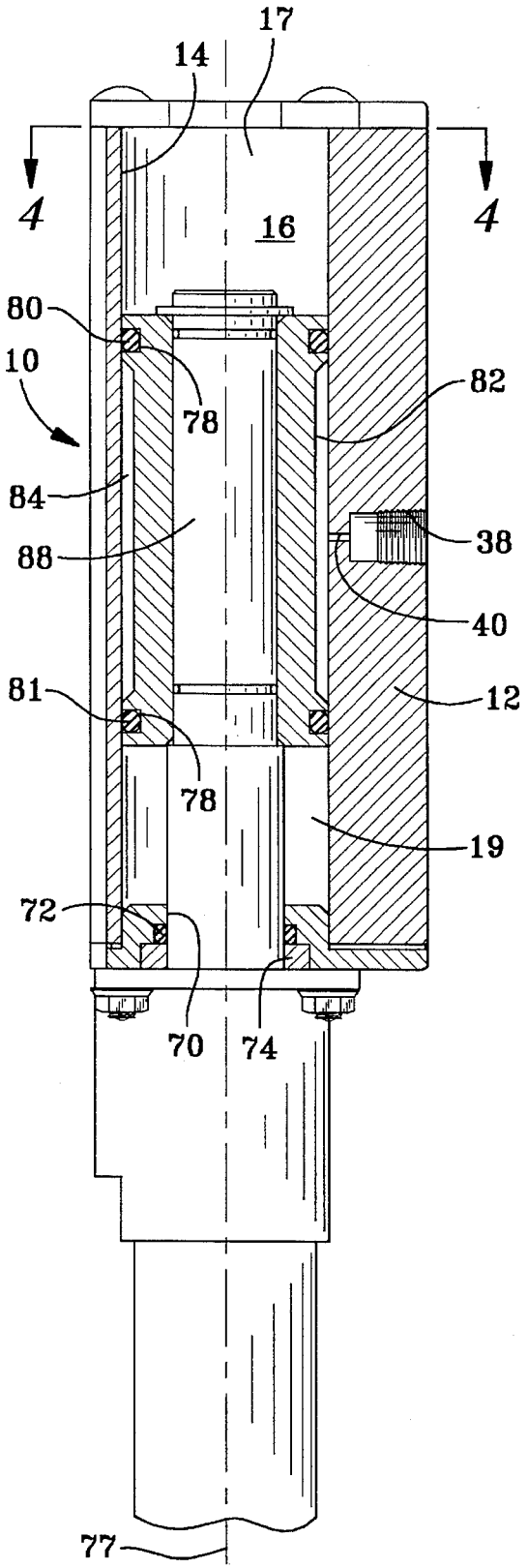
FIG. 2 is a sectional view taken along the longitudinal axis of the motor of the present invention, showing the motor piston in a first operating position.
Figure 1:
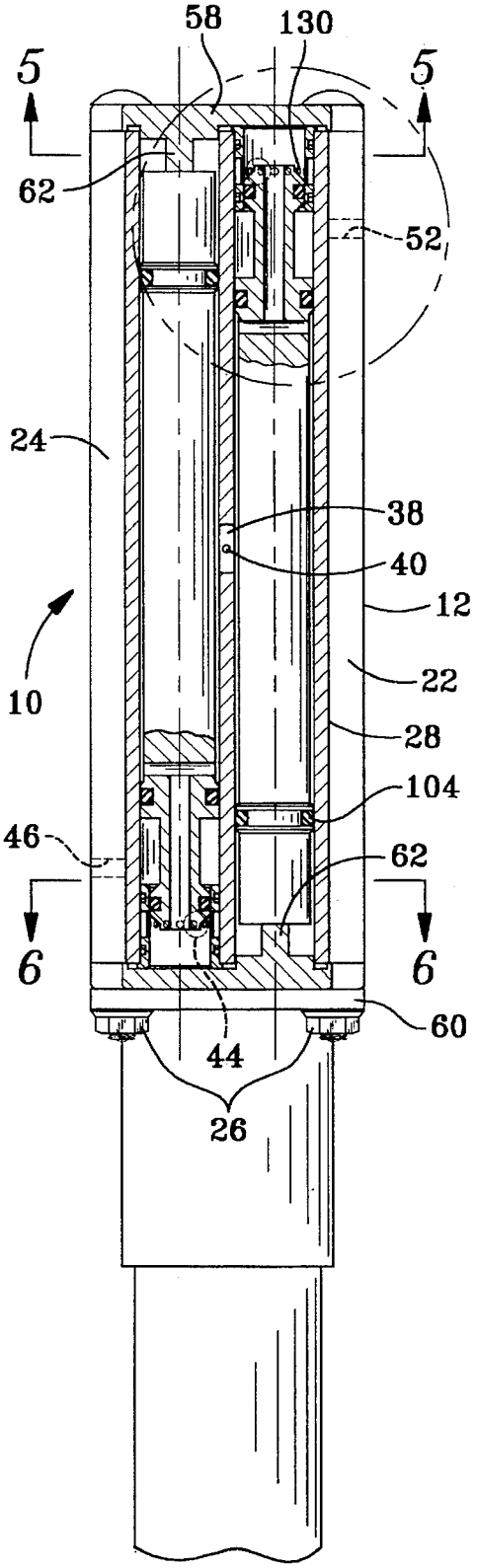
FIG. 1 is a sectional view taken along the longitudinal axis of the motor of the present invention, showing the three-way valves in a first operating position.
Figure 8A:
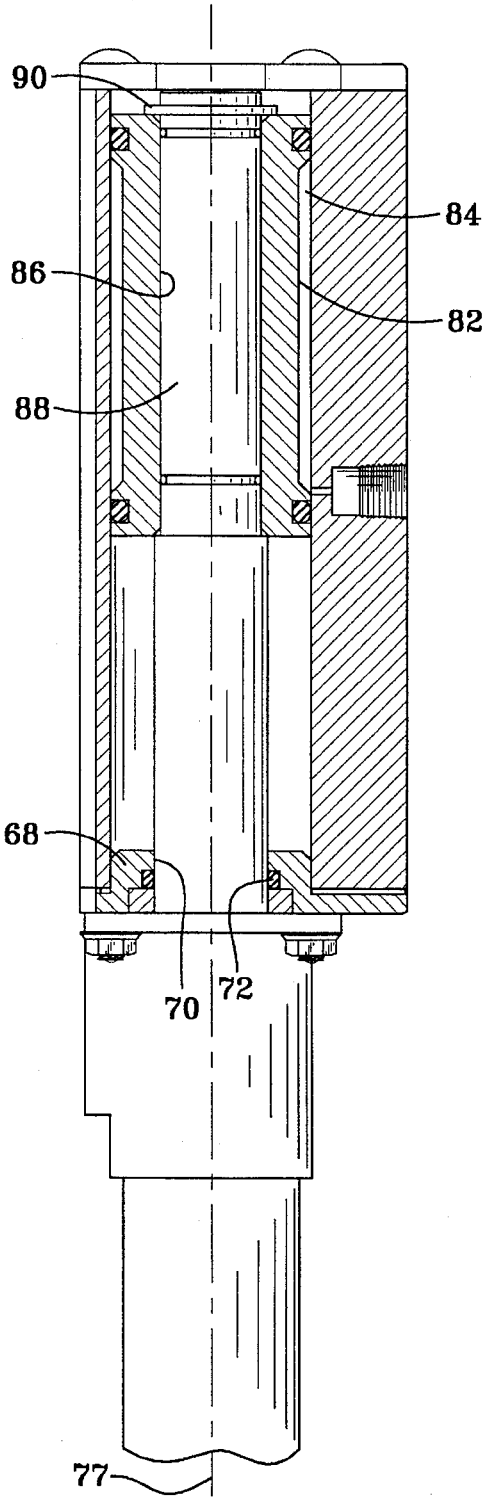
Figure 8B:
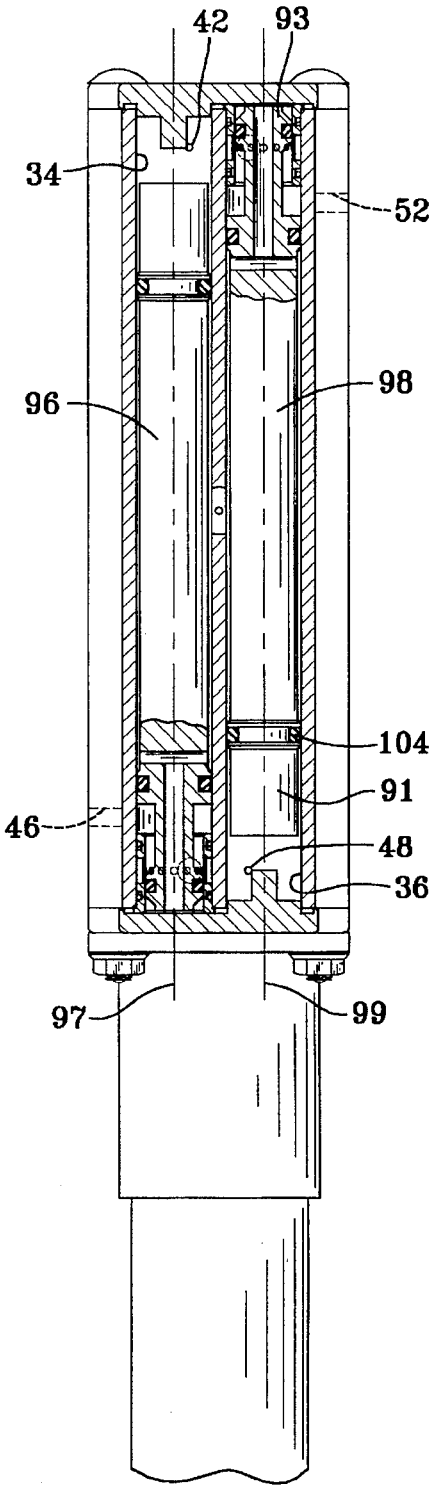
Figure 9A:
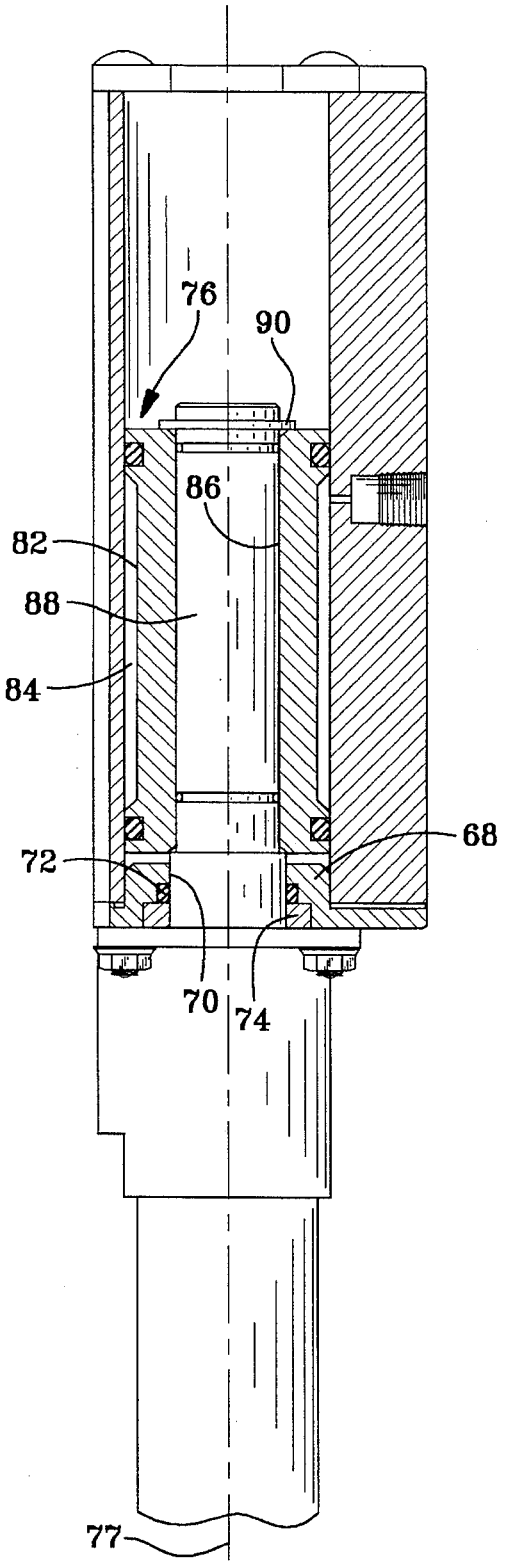
Figure 9B:
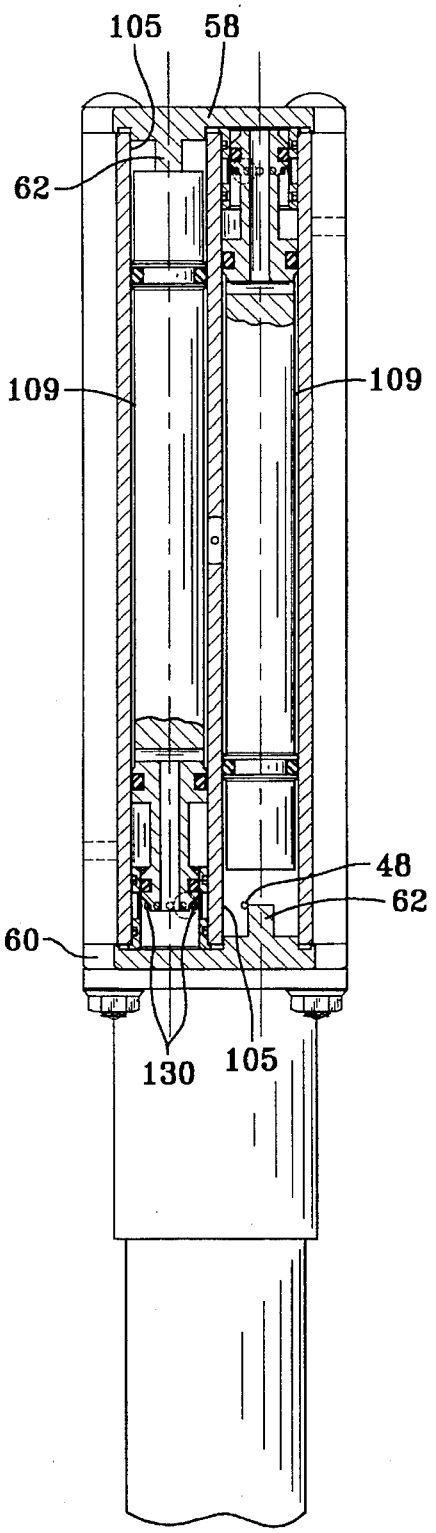

FIGS. 8*a* and 8*b* are the sectional views of FIGS. 1 and 2 showing the piston and three-way valves in a second operating position; and FIGS. 9*a* and 9*b* are sectional views of FIGS. 1 and 2 showing the piston and three-way valves in a third operating position.

DETAILED DESCRIPTION OF THE PREFERRED EMBODIMENT

Referring now to the drawings, wherein similar reference characters designate corresponding parts throughout the several views, FIGS. 1 and 2 show the pneumatic motor of the present invention, generally indicated at 10. The motor includes a main body 12 which may be formed by any suitable known process including, but not limited to, an extrusion process, a machining process or a casting process. The main body includes a piston bore 14 having cylindrical wall which defines a piston chamber 16. The chamber extends through the body 12.

Figure 4:
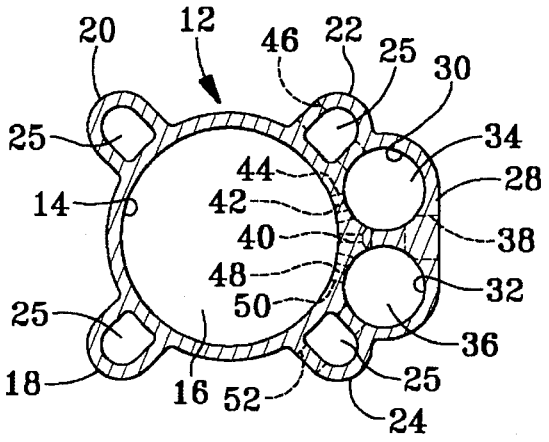
FIG. 4 is a lateral sectional view of the motor body taken generally along line 4—4 of FIG. 2.
Figure 5:
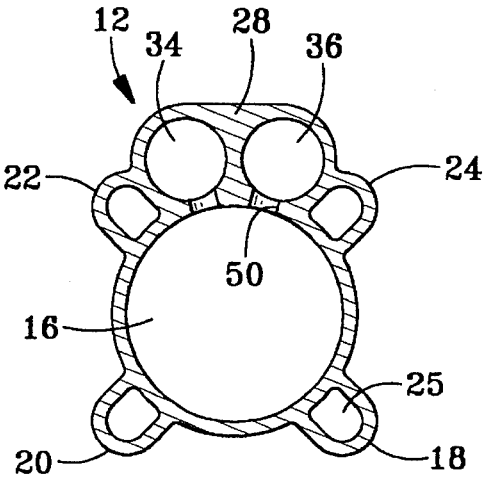
FIG. 5 is a lateral sectional view of the motor body taken generally along line 5—5 of FIG. 1.
Figure 6:
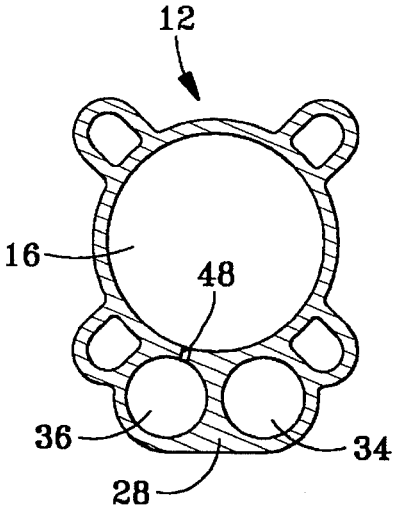
FIG. 6 is a lateral sectional view of the motor body taken generally along line 6—6 of FIG. 1.

Also formed along the body 12 are four ribs 18, 20, 22, and 24 that are made integral with the main body and extend longitudinally along the body 12. As shown in FIG. 4, the ribs are spaced equidistantly around the piston bore so that each rib is separated from the next adjacent rib by approximately 90 degrees. Additionally, each rib includes a passageway 25 that extends through the rib and is adapted to receive an elongate, conventional tie-rod member 26.

Body 12 includes a valve portion 28 made integral with the body between ribs 22 and 24. See FIGS. 1 and 4. Like ribs 18, 20, 22, and 24, the valve portion extends longitudinally between the ribs and also includes first and second cylindrical bores 30 and 32 respectively which have cylindrical walls which define first and second valve chambers 34 and 36. The valve chambers extend through the valve portion 28 and are located side-by-side. Alternatively, one valve chamber may be located between ribs 22 and 24 and one valve chamber may be located between ribs 18 and 20.

A main supply port 38 is formed in the valve portion 28 and extends laterally, through the walls of valve chambers 34 and 36. As shown in FIG. 2, the supply inlet is located approximately halfway along the longitudinal length of the valve portion. A pressurized fluid, such as compressed air, is flowed from a compressor through the inlet port to the valve chambers. The walls of the main supply port are partially threaded so that a supply hose or other conventional supply means can be removably connected to the supply inlet. Piston chamber supply port 40 flow connects the main supply port and the piston chamber 16. As shown in FIG. 1, the piston chamber supply port 40 is not as wide as supply port 38.

First and second ports 42 and 44 shown in dashed font in FIG. 4, are formed in the wall of chamber 16 and flow connect chambers 16 and 34. First port 42 is formed along the upper portion of the chamber wall above port 38, near head cap 58 and second port 44 is located along the bottom of the chamber wall below port 38 and near base cap 60. Port 44 is also shown in dashed font in FIG. 1 and port 42 is shown in FIG. 8*b*. Third port 46 extends through rib 22 and flow connects the chamber 34 with the exterior portion of main body 12. Third port 46 is an exhaust port for exhausting pressurized fluid from chamber 16. Ports 42 and 44 function as both supply ports for supplying pressurized fluid to the valve chamber and piston chamber and also as exhaust ports.

Fourth, fifth and sixth ports 48, 50 and 52 like ports 42, 44 and 46 are formed in the main body 12. Fourth port 48, like port 42, is formed along the bottom portion of wall of chamber 16 near base cap 60 and fifth port 50, like second port 44 is formed along the upper portion of chamber wall near head cap 58. Port 50 is shown in dashed font in FIG. 1. Sixth port 52, like third port 46 extends through rib 24. In this way ports 48 and 50 flow connect the chamber 16 and valve chamber 36 and sixth port 52 flow connects valve chamber 36 and the exterior of the main body 12. Like ports 42, 44 and 46, ports 48 and 50 function as supply and exhaust ports and port 52 functions primarily as an exhaust port. Port 52 is shown in FIG. 1.

The upper end of the body 12 is closed by head cap 58 and the bottom end of the body is substantially closed by base cap 60. Both the head and base caps are provided with four openings which are adapted to receive one end of the tie-rods 26 when the tie rods are inserted through the rib passageways 25. Conventional nuts are threadably fastened to the free tie-rod ends to hold the caps in place. Head cap 58 and base cap 60 are each provided with an integral protuberance 62 which is located outwardly from the center of the cap in the required position along each respective cap so that when the head cap is located on the upper motor end, the associated protuberance is located in chamber 34 at the upper end of the chamber, and when base cap 60 is located on the lower motor end, the associated protuberance is located in the lower end of chamber 36. See FIG. 1. The protuberances prevent the spool members in the chambers 34 and 36 from sticking during operation of the motor. Conventional seals (not shown) are sandwiched between each end cap and the main body 12 to seal each motor end.

Base cap 60 also includes an integral hub 68 which is located in the lower portion of chamber 16 when the base cap is seated on the lower end of the body 12. A stepped opening 70 extends through the hub 68. A conventional O-ring seal 72 is seated on one of the steps of the opening and is sandwiched between a bushing 74 and the hub.

A piston member 76 is adapted to be movable in chamber 16 along a path defined by axis 77. The piston separates chamber 16 into upper chamber 17 and lower chamber 19. The piston has a cylindrical body with an annular grooves 78 formed in the exterior portion of the piston body near each piston body end. O-ring type seals 80 and 81 are seated in each groove and sealingly engage the wall of chamber 16. An annular piston groove 82 is formed along the exterior of the piston body, between grooves 78, as shown in FIG. 2. The piston groove is substantially U-shaped and in combination with the wall of chamber 16 defines an annular chamber 84 which is continuously in fluid receiving communication with supply port 40 as the piston moves through the chamber during operation of motor 10. The piston includes a central bore 86 which is adapted to receive one end of a stepped piston rod 88. The narrow end of the piston rod is passed through opening 86 and is held in place by a conventional snap-ring 90 and a shoulder of the stepped connecting rod is held in abutment against the piston. As shown in FIG. 2, the wide portion of the rod passes through the opening 70 in cap 60 and seal 72 sealingly engages the rod. The rod is operatively connected to a pump (not shown) or other device so that the reciprocating motion produced by motor 10 may be used to pump a fluid to an object of interest.

Two grooves are formed along the narrow portion of rod 88 and a seal 92 is seated in each groove. The seals sealingly engage the wall of bore 86 and in this way seal the upper and lower chambers 17 and 19.

Elongate, substantially cylindrical first and second spool members 96 and 98 are located in valve chambers 34 and 36 to be movable in the valve chambers along axes 97 and 99 respectively. At least two spools must be used however any suitable number of spools may be used. As shown in FIG. 1, the spools are identical and are oriented 180 degrees opposite to each other so that corresponding ends of the spool members are located adjacent opposite caps. Since the spools are identical, as the description proceeds, only one spool will be described. However, when the operation of motor 10 is described hereinbelow, the relative movement of both spools will be discussed.

Spool 98 has first closed end 91 and a second substantially closed end 93. A first flow passage 100 is located near the second end 93 and is oriented along the diameter of the spool and extends through the spool body. A second flow passage 102 is oriented along longitudinal axis 99 and is substantially perpendicular to first flow passage 100. This internal porting keeps warm supply air in the exhaust area to reduce ice formation during motor. The flow passage 102 forms an opening at the second end 93 and flow connects the first passage 100 with the exterior of the spool.

A first spool seal 104 is located along the spool body near the first spool end 91. The first spool seal forms a seal with the wall of valve chamber 36 and is located at a position along the spool so that during operation, the first valve seal is always located between port 40 and fourth port 48. The seal 104, base cap 60 and chamber 36 define a first spool chamber 105. The corresponding chamber associated with spool 96 is defined by seal 104, head cap 58 and chamber 34. During operation, pressurized fluid located in the spool chamber acts as a spring to support the corresponding spool. The volume of chamber 105 varies during motor operation.

Figure 3:
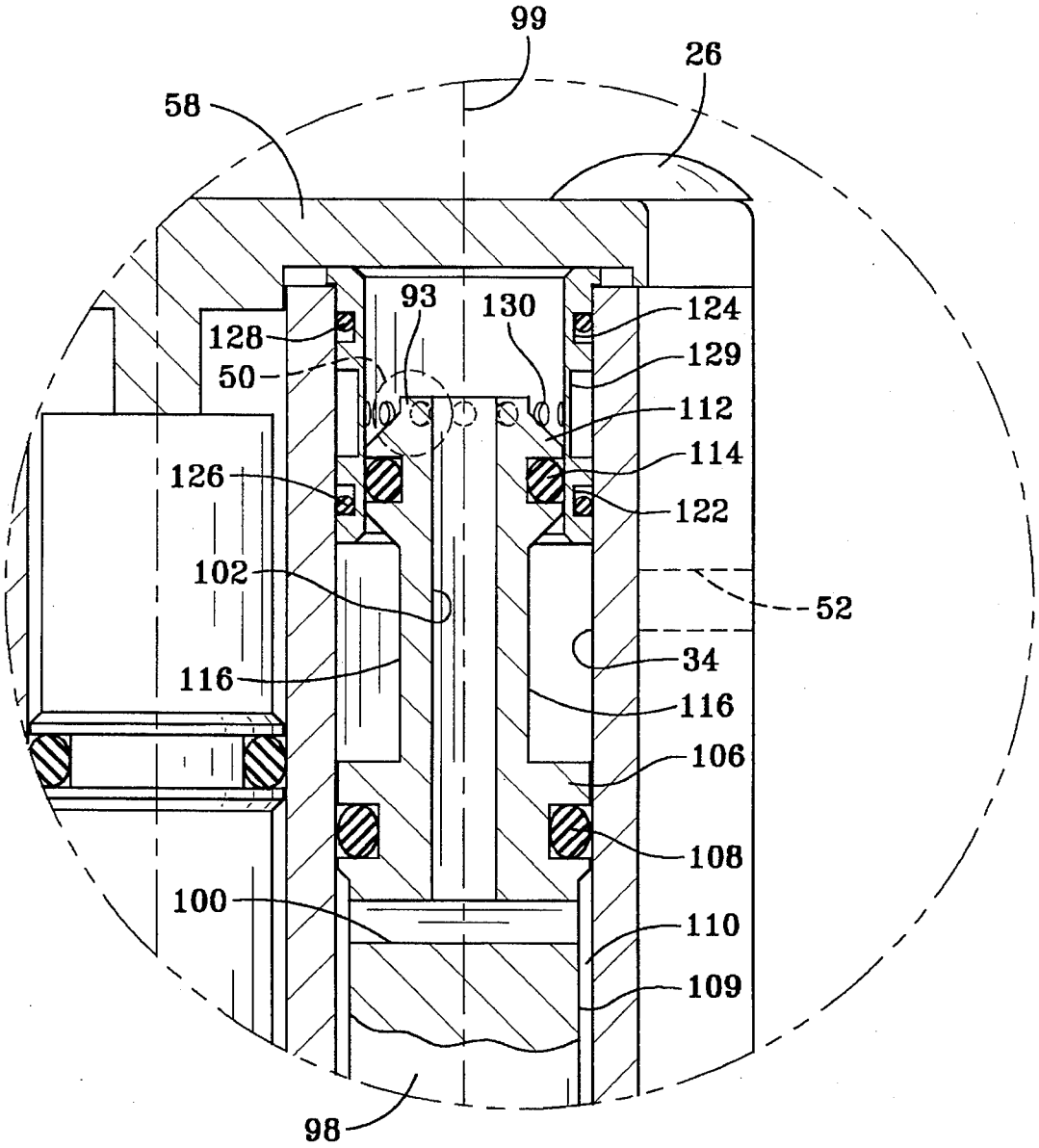
FIG. 3 is an enlarged sectional view of one of the three-way valves shown in FIG. 1.

Now referencing the detailed spool end view of FIG. 3, spool 98 also includes an integral annular shoulder 106 located adjacent first flow passage 100 and also includes an annular groove adapted to receive a second spool seal 108 which forms a seal with the valve chamber wall. An annular spool groove 109 is formed along the outside of the spool between the shoulder 106 and first spool seal 104. The first spool seal 104, valve chamber wall and shoulder 106 and spool groove 109 form an annular chamber 110 that is in fluid receiving communication with port 38. In this way, pressurized fluid is introduced into the valve chamber at the annular chamber 110.

A second integral annular shoulder member 112 is included along the length of the spool at second end 93 and includes a groove adapted to receive a third spool seal member 114. The two shoulders and portion of the spool between the shoulders forms an annular spool exhaust cavity 116. The spool cavities are in fluid communication to atmosphere by ports 46 and 52.

Figure 7:
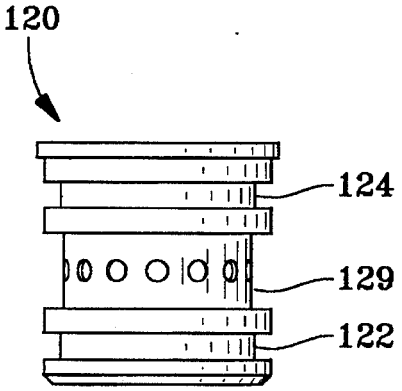
FIG. 7 is a side view of the valve sleeve located at one end of each valve.

A hollow, substantially cylindrical sleeve member 120 having open ends is shown in FIGS. 1 and 7, and is seated in the end of valve chamber 34 with the second end 93 of spool member 98 located in the hollow sleeve. The seal 114 engages the sleeve during motor operation. The sleeve has a substantially cylindrical body with annular grooves 122 and 124 formed in the sleeve adjacent the sleeve ends. See FIG. 7. First and second sleeve seals 126 and 128 are located in the grooves 122 and 124 to form a seal with the valve chamber wall.

A third annular groove 129 is included along the sleeve between grooves 122 and 124 and a plurality of discrete ports 130 are formed in an annular pattern along the sleeve in the third groove 129. In the preferred embodiment, twelve discrete ports are provided however any suitable number of ports may be provided. When the sleeve is located in the respective chamber the ports are aligned with the second and fifth ports 44 and 50. See the dashed font representation of port 50 in FIG. 3. Third and sixth ports 46 and 52 are located adjacent the open end of the sleeve located away from the respective cap. During operation of motor 10, third spool seal 114 repeatedly moves across the ports 130. When the seal 114 is located on one side of the ports away from cap 58, the ports are flow connected to chamber 105 and when the seal is on the other side of the ports adjacent cap 58, the ports 130 are flow connected to cavity 116. In this way the sleeve acts as a three-way valve.

Operation of motor 10 will now be described. Referring now to FIGS. 1 and 2, a compressed fluid such as air is flowed through main inlet 38 into annular chambers 110 associated with spools 96 and 98 and through port 40 into piston annular chamber 84. The air in chamber 110 flows through first flow passage 100, second flow passage 102 and adjacent the second end 93 of each spool. The air flows into chamber below spool second end 93, through ports 130, second and fifth ports 44 and 50 and into the piston chamber 16. As a result, spool 96 is forced upward so that end 91 bottoms out against protuberance 62 of cap 58, and spool 98 is forced downward so the first end 91 bottoms out against the protuberance 62 of cap 60. Piston member 76 is positioned in chamber 16 nearer to the base cap 60 than head cap 58.

The air flows through the second port 44 into piston chamber 19. Air enters the chamber above the piston through fifth port 50. As the lower chamber fills with air, the air flows Out fourth port 48 and into the chamber 105 below the first end 91 of spool 98, forcing spool 98 upward toward the cap 58. The second end 93 of spool 98 bottoms out against the cap 58 and the air in the chamber above the piston is exhausted out the motor through fifth port 50, through sleeve ports 130, cavity 116 and out the body 12 through sixth port 52. After the air is exhausted, the piston is forced upward toward head cap 58 by the compressed air bin piston chamber 19.

As the piston moves upward, the piston seal 80 moves past first port 42, and the air in annular piston chamber 84 is then supplied to the chamber 105 and the spool is forced downward toward base cap 60. Air in lower piston chamber is exhausted out of the chamber through second port 44, through sleeve ports 130 and sleeve 120, through cavity 116 and out the main body 12 through third port 46. The spools and piston are now in the positions shown in FIGS. 8*a* and 8*b*. Air exhausts out fourth port 48 through third port 46 as described above, and as the air flows outward, the spool 98 displaces downward until the end bottoms out against the protuberance of base cap 60. Air then is flowed into the piston chamber 16 above the piston through passages 100 and 102 in the manner previously described hereinabove.

As air is flowed above piston and exhausted out of the lower piston chamber, the piston is forced downward toward end cap 60 and when piston seal 81 passes fourth port 48, air flows through fourth port 48 and forces spool 98 upward toward end cap 58 permitting air above the piston to exhaust out fifth port 50 and sixth port 52 in the manner previously described. Air also exhausts through first port 42. As the air exhausts out port 42, the air in annular chamber 110 forces spool 96 upward toward protuberance 62.

Inlet air is flowed through passages 100 and 102 into the chamber below the piston and the process is repeated. The piston moves in a rapid reciprocating manner until the supply of air is terminated.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

Having described the invention, what is claimed is:

1. A pneumatic motor, comprising:

a) a motor body having a piston chamber with opposed chamber ends, at least two valve chambers, inlet means for flowing a pressurized fluid into the piston chamber and each of the at least two valve chambers, outlet means provided in the housing for exhausting the pressurized fluid from the piston chamber and each of the at least two valve chambers;

b) a three-way valve member adapted to be located in each of the at least two valve chambers, said valve members having at least one open end and at least one port formed along the valve member body;

c) at least one spool member located in one of said valve chambers, each spool member having a first end adapted to be located in the open end of the valve member, said spool members adapted to be movable in a first direction relative to the valve member to permit pressurized fluid to be supplied to the piston chamber and also in a second direction relative to the valve member to permit the pressurized fluid in the piston chamber to be exhausted from the chamber; and d) a piston movable in a reciprocating manner in the main chamber in response to movement by the spools relative to the three-way valve members.

2. The pneumatic motor as claimed in claim 1 wherein the motor body has a first end and a second end, and also wherein there are two valve chambers and two spool members, each spool member also having a second spool end, said first end of one spool member located proximate the first body end, said second end of said one spool member located proximate the second body end, said first end of the other spool member being located proximate said second body end and the second spool end of the other spool member being located proximate the first body end.

3. The pneumatic motor as claimed in claim 2 wherein each spool includes a first spool seal adjacent the first spool end, a second spool seal adjacent the second spool end, and an annular spool groove along the outer periphery of the spool body between the first and second spool seals, said groove and piston chamber defining a spool chamber.

4. The pneumatic motor as claimed in claim 3 wherein each spool member includes a flow passage extending between the spool chamber and the second end of the spool member.

5. The pneumatic motor as claimed in claim 4 wherein the flow passage is comprised of a substantially laterally extending portion and a substantially longitudinally extending portion.

6. The pneumatic motor as claimed in claim 2 wherein the main body includes a plurality of rib members along the exterior of the body, said valve chambers both being located between two of said ribs.

7. The pneumatic motor as claimed in claim 2 wherein each valve chamber includes a sleeve adapted to be seated in the valve chamber adjacent the second spool end, said sleeve having a first sleeve seal, a second sleeve seal and flow path between the sleeve seals.

8. The pneumatic motor as claimed in claim 7 further including a third spool seal at the second spool end, said third seal adapted to sealingly engage the sleeve member.

9. The pneumatic motor as claimed in claim 5 wherein each of said spools include a first shoulder and a second shoulder, said shoulders and spool defining a spool cavity.

10. The pneumatic motor as claimed in claim 1 wherein the piston member includes first and second sealing means for forming a seal between the piston and the chamber wall, said piston member including an annular groove along the outer periphery of the piston member between the first and second sealing means, said chamber wall and groove defining a movable piston chamber.

11. The pneumatic motor as claimed in claim 1 wherein the body has a first end and a second end, said first end being closed by a first end cap and said second end being closed by a second end cap.

12. The pneumatic motor as claimed in claim 10 wherein there are two valve chambers and each end cap includes a protuberance which is adapted to be located in one of the chambers when the caps are seated on the body ends.

* * * * *